US012714224B2

(12) United States Patent
Boddie

(10) Patent No.: US 12,714,224 B2
(45) Date of Patent: Aug. 25, 2026

(54) BREAST PUMP DRAWER SYSTEMS

(71) Applicant: Restful Pump, Inc., Pembroke, MA (US)

(72) Inventor: Micolene Boddie, Marshfield, MA (US)

(73) Assignee: RESTFUL PUMP, INC., Pembroke, MA (US)

( * ) Notice: Subject to any disclaimer, the term of this patent is extended or adjusted under 35 U.S.C. 154(b) by 123 days.

(21) Appl. No.: 18/680,860

(22) Filed: May 31, 2024

(65) Prior Publication Data

US 2024/0398116 A1 Dec. 5, 2024

Related U.S. Application Data

(60) Provisional application No. 63/505,133, filed on May 31, 2023.

(51) Int. Cl.

| | |
|---|---|
| ***A47B 83/00*** | (2006.01) |
| ***A47B 31/00*** | (2006.01) |
| *A47D 5/00* | (2006.01) |
| *A47D 9/00* | (2006.01) |
| *A47D 11/00* | (2006.01) |

(52) U.S. Cl.

CPC ..... *A47B 83/00* (2013.01); *A47B 31/00* (2013.01); *A47B 2031/003* (2013.01); *A47B 2031/006* (2013.01); *A47D 5/00* (2013.01); *A47D 9/00* (2013.01); *A47D 11/005* (2013.01)

(58) Field of Classification Search

CPC ... A47B 31/00; A47B 83/00; A47B 2031/003; A47B 2031/006; A47D 5/00; A47D 9/00; A47D 11/005; A61M 1/062; A61M 1/067

USPC ..... 312/209, 235.2, 235.3, 235.4, 235.5, 312/235.6, 235.7, 348.5

See application file for complete search history.

(56) References Cited

U.S. PATENT DOCUMENTS

| | | | | |
|---|---|---|---|---|
| 2,666,473 A * | 1/1954 | Dean | A47B 83/02 312/334.44 |
| 5,401,078 A * | 3/1995 | Riach | A47C 7/503 297/195.11 |
| 11,136,771 B2 * | 10/2021 | Petty | E04H 1/1272 |

(Continued)

OTHER PUBLICATIONS

International application No. PCT/US2024/032090. International Search Report and Written Opinion of the International Searching Authority Dated Sep. 30, 2024.

*Primary Examiner* — James O Hansen

(74) *Attorney, Agent, or Firm* — Troutman Pepper Locke LLP

(57) ABSTRACT

Breast pumping drawer systems are disclosed that include a breast pump drawer configured to be received by an interior compartment of a containing structure via guiding component(s) and including a headrest pin, a headrest cavity, slider cavities, and a support leg cavity. Bottle slider devices are configured to be received within the slider cavities. The bottle slider devices are further configured to attach to bottle holders. A base support leg is configured to be received within the support leg cavity. The base support leg is further configured to be positioned between the breast pump drawer and a floor surface to thereby support the breast pump drawer. A headrest is configured to be coupled to the headrest pin and comprising a headrest base configured to be received by the headrest cavity. The headrest is configured to rotate about the headrest pin to a desired angle.

20 Claims, 6 Drawing Sheets

(56) References Cited

U.S. PATENT DOCUMENTS

| | | | | |
|---|---|---|---|---|
| 2004/0160147 | A1* | 8/2004 | Bochner ..... | A61B 50/15<br>312/249.8 |
| 2016/0100888 | A1 | 4/2016 | Ferrari | |
| 2021/0121615 | A1 | 4/2021 | Boddie et al. | |
| 2022/0218885 | A1 | 7/2022 | Boddie et al. | |

* cited by examiner

BREAST PUMP DRAWER SYSTEMS

This application claims priority to U.S. Provisional Patent Application No. 63/505,133, filed May 31, 2023, which is hereby incorporated by reference herein in its entirety.

FIELD

This technology generally relates to breast pumping systems and, more particularly, to breast pump drawer systems that can be incorporated into any type of furniture to facilitate improved positioning and reduced medical complications for breast pumping women.

BACKGROUND

Feeding infant children using breastmilk has several advantages including increased infant health, increased protection against infections, diseases, and viruses, improved digestion relative to other forms of nutrition, and healthier weight as infants grow. To build a store of milk for feeding an infant, mothers often pump breastmilk for later consumption. Mothers that choose to pump breastmilk may enjoy several benefits. For example, pumping after breastfeeding sessions may increase milk supply and/or provide nipple stimulation to increase and maintain milk supply.

Additionally, breast pumping provides convenience for mothers and family members by facilitating subsequent bottle feeding by family members that can thereby improve their bond with the baby. Further, mothers can return to the workplace, perform tasks, and/or rest, for example, while other caregivers bottle feed. Even further, some mothers choose to sell breastmilk, or donate extra breastmilk to a milk bank, and surrogates may breast pump and donate breastmilk after a baby is born and living with their parents.

Pumping breastmilk may also be medically beneficial or even necessary in some instances. For example, breast pumping gives babies all the benefits of breastmilk if a mother has flat or inverted nipples or cannot nurse due to post-surgical complications, postpartum conditions, or an upper extremity disability (e.g., an amputee or another shoulder, elbow, or wrist diagnosis). Breast pumping may also be necessary to provide breastmilk for babies that cannot latch for medical reasons or complications, such as prematurity, weakness, low muscle tone, ankyloglossia, or general latch-on or suck difficulties.

However, many mothers struggle with milk production via breast pumping for many reasons, including stress and anxiety of caring for an infant, discomfort caused by breast pumping, and discomfort from the various body positions that must be maintained for extended periods of time during a breast pumping session. Additionally, nursing or pump bras introduce compression that may contribute to breast tissue complications, and/or obstructions that limit breast tissue massage, and may increase stress. Often, during breast pumping, a woman is seated with poor posture, leading to inefficient pumping, less milk extraction, and/or reduced milk production.

In addition to reduced milk expression, sub-optimal positioning during breast pumping can also lead to significant medical issues for women including neck, shoulder, and/or back pain or discomfort or other similar diagnoses, headaches or migraines, or exhaustion. Mothers that use current breast pumping devices in sub-optimal environments and positions may also have an increased susceptibility of developing clogged ducts. Current breast pumping devices also require mothers to hold bottles coupled to flanges, eliminating the ability to perform self-breast massage during breast pumping sessions to ensure efficient milk expression of the breasts and reducing the risk of medical complications of the breast tissue.

While forward-leaning breast pumping chair systems have been developed as disclosed in U.S. Patent Application Publication No. 2023/0398268 entitled "Breast Pumping System," which is hereby incorporated by reference herein in its entirety, these devices have limited portability and may not be available in all settings in which a mother may want to breast pump. For example, chair systems may consume too much space to be practically deployed for use by each mother in a hospital neonatal intensive care unit (NICU) where a significant number of other patient care systems and devices are required to assist with newborn health.

DETAILED DESCRIPTION

The disclosed technology generally relates to breast pump drawer systems, examples of which include a drawer that can be incorporated into any type of containing structure, which can be furniture, such as a changing table, dresser, or other nursery furniture (e.g., bassinet) or equipment, such as a portable medical treatment cart in a medical office or hospital setting, by way of example only. In one example, the furniture (e.g., a nightstand) can include electrical outlets for pump charging and/or a refrigerated compartment for pumped breast milk. While breast pump drawer systems within a containing structure are disclosed by way of the examples herein, the exemplary breast pump drawer systems can be included within and/or coupled to other types of devices, furniture, or structures in other examples. Embedded within the breast pump drawer of the exemplary breast pump drawer systems in some examples are structural components including a base support leg, headrest, and a milk collection system (e.g., including bottle slider devices configured to attached to bottle holders), among other components in other examples.

With this technology, a user can advantageously slide or pull, for example, the breast pump drawer out of the containing structure and extract and/or connect the structural and other components contained within the breast pump drawer to thereby install or set up a breast pumping or lactation system or station that provides a supportive, hands-free, forwarding-leaning position, using any type of breast pump. For a user sitting in a chair or on any other surface, or standing, the forward-learning ergonomic breast pumping system of this technology provides comfort, convenience, and improved productivity (e.g., increased expression), may reduce breast tissue complications (as a result of the forward-leaning position, for example), and increases breast pumping duration, among many other advantages.

Figure 1A:
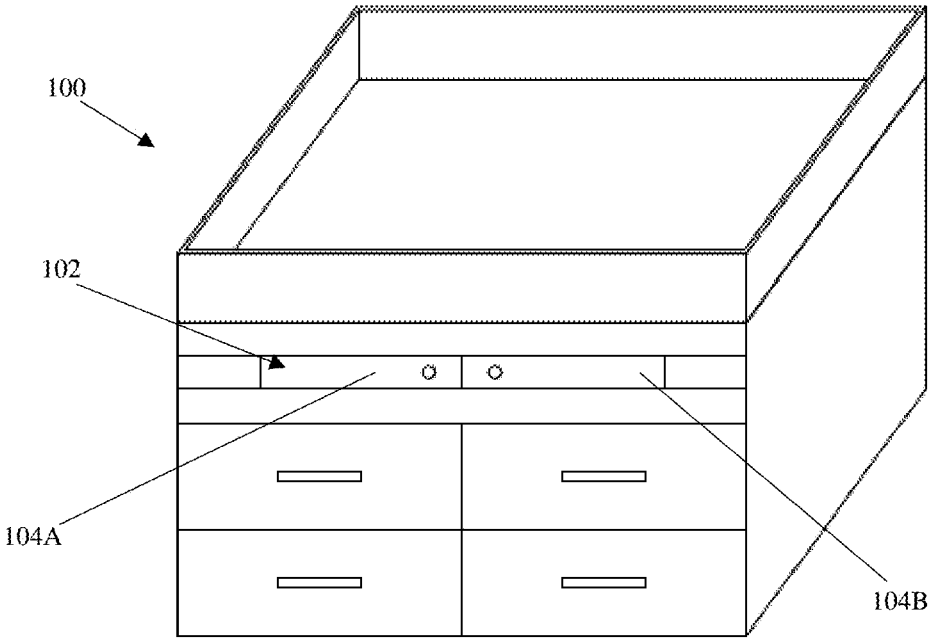
FIGS. 1A-B are perspective views of furniture that incorporates an exemplary breast pump drawer system.
Figure 1B:
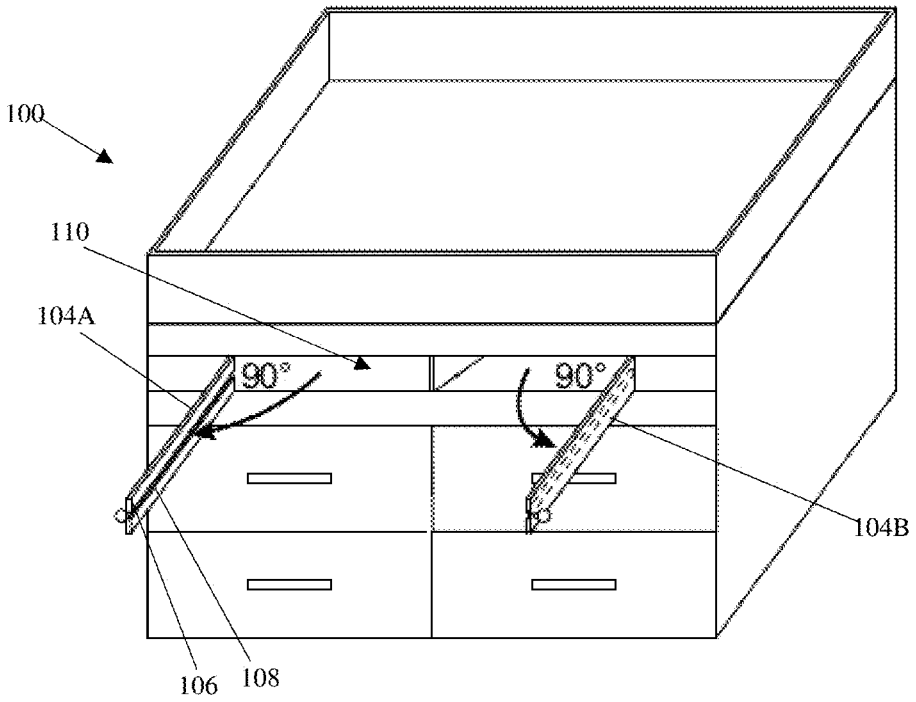

Referring to FIGS. 1A-B, an exemplary containing structure 100 that incorporates a breast pump drawer system 102 according to some examples of this technology is disclosed. In this example, the containing structure 100 includes first and second doors 104A-B each hinged at opposing exterior sides such that the first and second doors 104A-B open in a parallel arrangement. In some examples, one or both of a first interior surface 106 or a second interior surface (not shown in FIGS. 1A-B) of the first or second doors 104A-B, respectively, includes a track, rail, or other guiding component 108 configured to receive a breast pump drawer (described below with reference to FIG. 2, for example) that is pulled or otherwise manipulated into the guiding component 108 by a user.

In other examples, the containing structure 100 may not include any doors and the breast pump drawer system 102 in these examples may extend or slide away from the containing structure 100 without any portion of the containing structure separate from the breast pump drawer system 102 opening or otherwise moving. While the breast pump drawer system 102 can be part of the containing structure 100, the breast pump drawer system 102 may also be retrofitted into any containing structure in other examples. Additionally, the containing structure 100 may take any form and have any type of design.

Optionally, one or both of the first interior surface 106 or the second interior surface can include a locking mechanism by which the breast pump drawer 200 is configured to engage (e.g., when fully extracted from within an interior compartment 110 of the containing structure 100 disposed behind the first and second doors 104A-B) to thereby lock or otherwise retain the breast pump drawer in an extended position. Other types of guiding components including rails, slides, or other extension devices can also be used in other examples and other methods and types of devices can also be used to facilitate extension of the breast pump drawer out of the containing structure 100.

Figure 2:
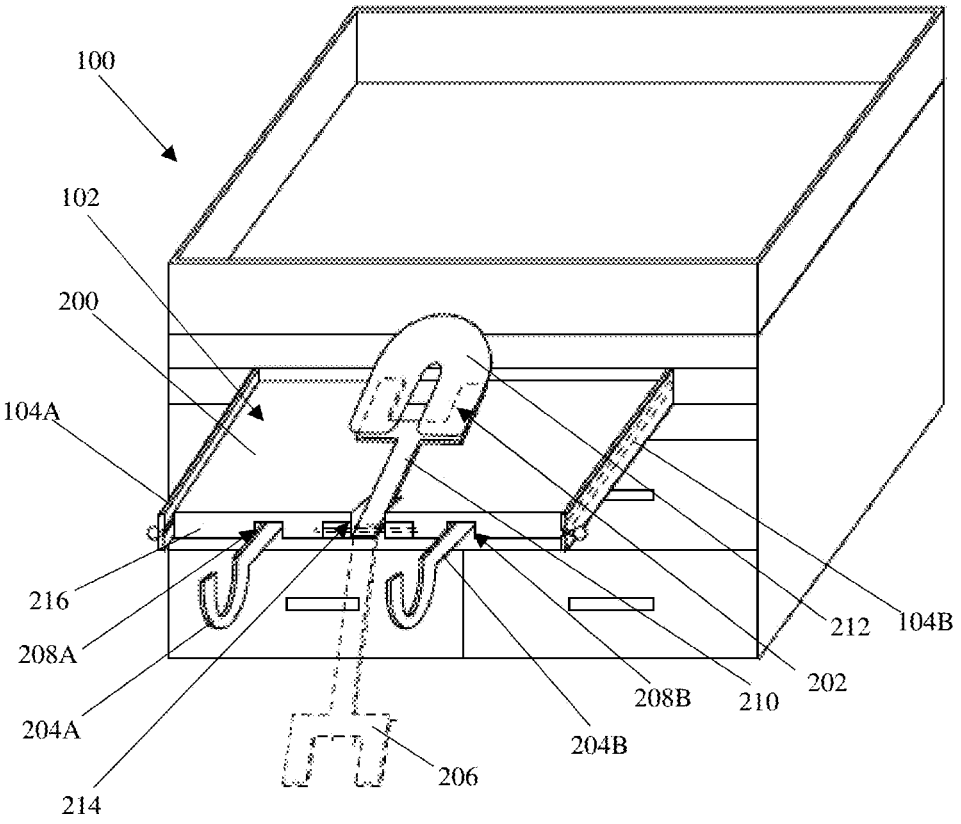
FIG. 2 is a perspective view of the exemplary breast pump drawer system of FIG. 1 in an extended position.

Referring to FIG. 2, the breast pump drawer system 102 in an extended position with installed structural components is illustrated. In this example, the breast pump drawer system 102 includes a breast pump drawer 200 configured to contain embedded therein structural components that can be manipulated by a user to connect together to form a breast pumping system. More specifically, the structural components in some examples can include one or more of a headrest 202, a milk collection system (e.g., bottle slider devices 204A-B configured to attached to bottle holders), and/or a base support leg 206, for example. The structural components can be contained within the breast pump drawer 200 as described and illustrated below with reference to FIGS. 3-4. While the milk collection system is disclosed in some examples herein as including the bottle slider devices 204A-B, which are configured to attach to bottle holders that retain bottles for collection of expressed breast milk, other types of milk collection systems with other components can also be used in other examples of this technology, including as described below with reference to the bottle attachment device illustrated in FIG. 6.

In operation, a user can open the first and second doors 104A-B, slide the breast pump drawer 200 within the guiding component 108 to a locked, extended position, pull the bottle slider devices 204A-B out from within respective slider cavities 208A-B of the breast pump drawer 200, extract the base support leg 206 from within a leg cavity (described below with reference to FIG. 6) of the breast pump drawer 200, and extract the headrest 202, or one or more portions thereof, from a headrest cavity (described below with reference to FIGS. 3-4) of the breast pump drawer 200. As used herein, the term cavity can include any through hole, aperture, recess, indentation, slot, opening, or track, for example.

The extracted base support leg 206 can then be coupled to the breast pump drawer 200 via a leg hinge (described below with reference to FIG. 6). Additionally, the headrest base 210 of the headrest 202, which is attached to a headrest cushion 212 of the headrest 202, can be coupled to the breast pump drawer 200 via a headrest pin 214. The leg hinge and the headrest pin 214 are disposed on a front exterior surface 216 of the breast pump drawer 200 in some examples, although the leg hinge and/or headrest pin 214 can be coupled to the breast pump drawer 200 at other locations in other examples. The headrest pin 214 is optionally locking and adjustable such that the headrest 202, including headrest cushion 212, is retained in a particular angled position relative to a top surface of the breast pump drawer 200. Other types of locking mechanisms including collars that mate with the breast pump drawer 200 or adjustable hinged supports coupled to the headrest 202 and extending between the headrest 202 and the top surface of the breast pump drawer 200 can also be used in other examples.

Figure 3:
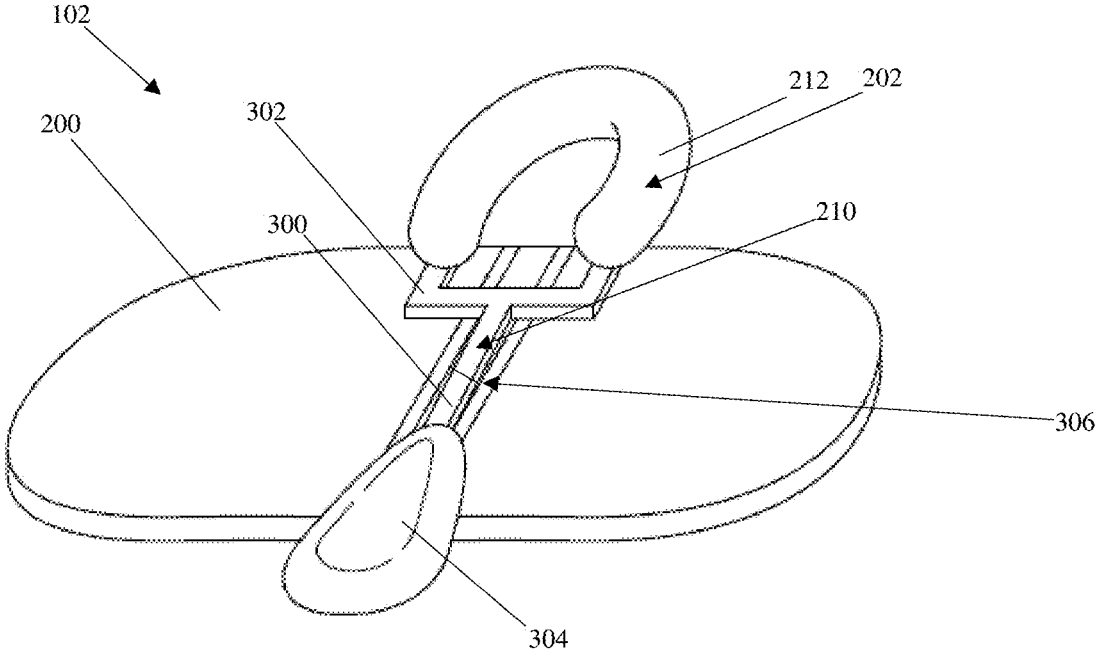
FIG. 3 is a perspective view of an exemplary removable and/or adjustable headrest that can be used with the exemplary breast pump drawer system of FIG. 1.

Referring to FIG. 3, an exemplary removable and/or adjustable headrest 202 of an exemplary breast pump drawer system 102 is illustrated. The headrest 202 in this example includes the headrest base 210, which includes a proximal post 300 and a distal mount 302 configured to couple to the headrest cushion 212. While the headrest base 210, and proximal post 300 and distal mount 302 thereof, and headrest cushion 212 are described herein as separate components, any number of these components can be formed as a unitary structure. The headrest base 210 is configured to attach via the headrest pin 214 to stability bar(s) (examples of which are described below with reference to FIG. 4) within or coupled to a bottom of the breast pump drawer 200. The headrest pin 214 rotatably receives at least the proximal post 300 of the headrest base 210.

In some examples, the distal mount 302 is removable from the proximal post 300 and/or height-adjustable within the proximal post 300 (e.g., via a telescoping or locking pin configuration). In yet other examples, the proximal post 300 can be detached from the headrest pin 214 for complete removal of the headrest 202 from the breast pump drawer system 102. In yet other examples, the headrest pin 214 may be removed to disassemble the breast pump drawer system 102, which will remove the forward-leaning padding (e.g., chest cushion 304 that is independently removable and attaches to the proximal post 300) and all components of the headrest 202 entirely. When removed, the breast pump drawer system 102 may also be used as a regular desk, or workstation/table, without the support for forward-leaning lactation.

Thus, the proximal post 300 locks into the breast pump drawer 200 via the headrest pin 214 to support a user leaning forward while standing or sitting on any height-appropriate surface or other locking mechanisms may be used to secure the desired forward-leaning position of the proximal post 300 and/or distal mount 302 of the headrest 202. The standing position for a user facilitates dangle pumping while a seated position (e.g., with the headrest 202 attached) allows a forward-leaning position for work or rest. In other examples, the headrest 202 may be removed (e.g., as explained above) and/or unutilized to facilitate use of the top of the breast pump drawer 200 as a workstation, for example. The headrest 202 can be configured to rotate via the proximal post 300 about the headrest pin 214 to be received by and retained within a headrest cavity 306 of the breast pump drawer 200. In some examples, the distal mount 302 of the headrest 202 can be removed (with the headrest cushion 212) and stored inside the breast pump drawer 202 so that the headrest 202 can be retained within the headrest cavity 306 of the breast pump drawer system 102.

Irrespective of whether the headrest is installed or utilized, the proximal post 300 and/or headrest base 210 can be configured to attach to a chest cushion 304 (e.g., via hook and loop fasteners (e.g., Velcro™) or any other fastening mechanism) to thereby support a user in a forward-leaning position that advantageously encourages efficient milk expression and reduces susceptibility or risk of breast tissue complications. Additionally, a triangular post (not shown) can be used in some examples in which the chest cushion 304 attaches to a front of the triangle post and the headrest 202 or a portion thereof (e.g., the distal mount 302) is inserted into the triangle post at an apex above the chest cushion 304. One or both of the headrest cushion 212 or the chest cushion 304 (and/or the triangle post) can be retained within and/or mounted to (e.g., underneath) the breast pump drawer 200, for example, as explained in more detail below, and other configurations can also be used.

A user can then use the breast pump drawer system 102 from a seated position in any chair by attaching a bottle to each of the bottle slider devices 204A-204B or other milk collection system for retaining expressed breast milk. The bottles can be in fluid communication with a breast pump device (not shown) for facilitating the expression of the breast milk. The breast pump device can be integrated within and/or retained by the breast pump drawer 200 in some examples, while the breast pump device can also be external to the breast pump drawer system 102 and placed on a top surface of the extended breast pump drawer 200, in other examples. In the latter examples, the breast pump device and/or accessories may or may not be included with the containing structure 100 and/or breast pump drawer system 102 described and illustrated by way of the examples herein.

Figure 4A:
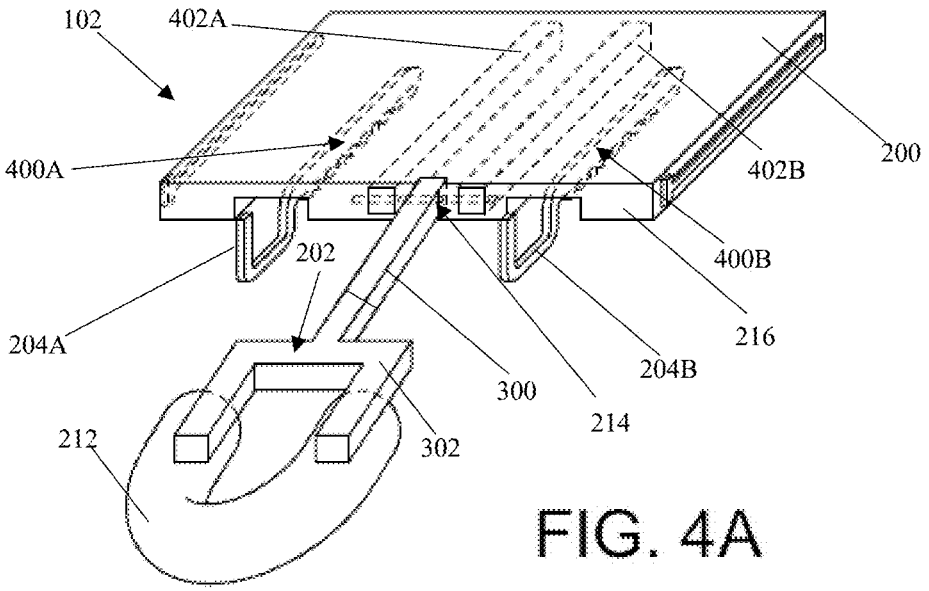
FIGS. 4A-B are above perspective views, respectively, of an exemplary breast pump drawer system of FIG. 1.
Figure 4B:
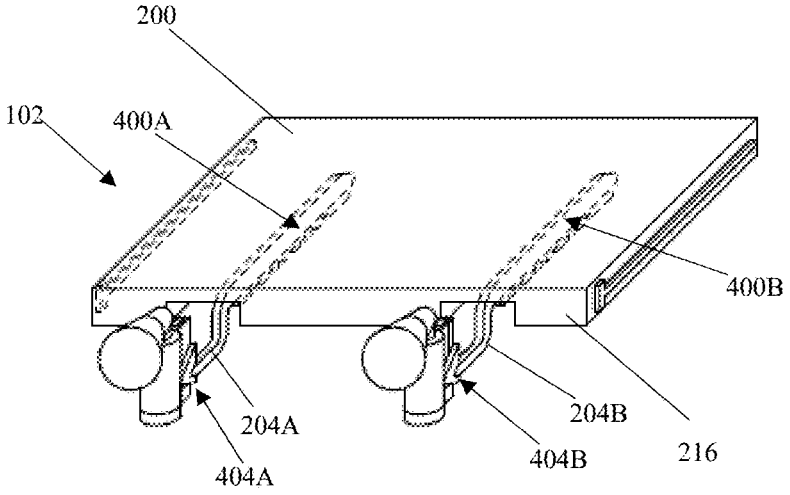

Referring to FIGS. 4A-4B, above perspective views of an exemplary breast pump drawer system 102 is illustrated. In this example, the breast pump drawer 200 retains the bottle slider devices 204A-B within slider cavities 400A-B, respectively, such that the bottle slider devices 204A-B can be extended when in use. Similarly, the headrest 202, or one or more portions thereof (e.g., the proximal post 300), can be extended by a user from the headrest cavity 306 (illustrated in FIG. 3, for example) formed in the breast pump drawer 200 and locked into place at a desired length and/or angle. Optionally, stability bars 402A-B made of aluminum, another metal, wood, or another material, can be disposed within an interior of, or coupled to a bottom of, the breast pump drawer 200 for connectivity to one or more of the structural components (e.g., the headrest pin 214) and/or for guiding the breast pump drawer 200 within the containing structure 100, for example.

The bottle slider devices 204A-B can be configured to couple to bottle holders 404A-B or containers of another milk collection system, such as via posts as disposed at distal ends of the bottle slider devices 204A-B and configured to receive the bottle holders 404A-B, respectively. In other examples, bands, hook and loop fasteners, straps clips, and/or ball joints facilitating several degrees of movement and/or rotation can be used to couple the bottle holders 404A-B to the bottle slider devices 204A-B, respectively, and/or another portion of the breast pump drawer system 102 (e.g., the breast pump drawer 200, the proximal post 300 of the headrest 202, or the base support leg 206 as explained below with reference to FIG. 6). Any other mechanism for coupling bottles with attached flanges to the bottle slider devices 204A-B can also be used in yet other examples.

Optionally, the bottle holders 404A-B and/or bottle slider devices 204A-B can be adjustable in any number of directions to facilitate a comfortable, effective, and healthy flange/bottle position for a user of the breast pump drawer system 102. Additionally, some users may prefer to wear a pump bra to hold flanges and/or remove the bottle slider devices 204A-B from the breast pump drawer 200 and wear their breast pump in their bra(s).

Figure 5:
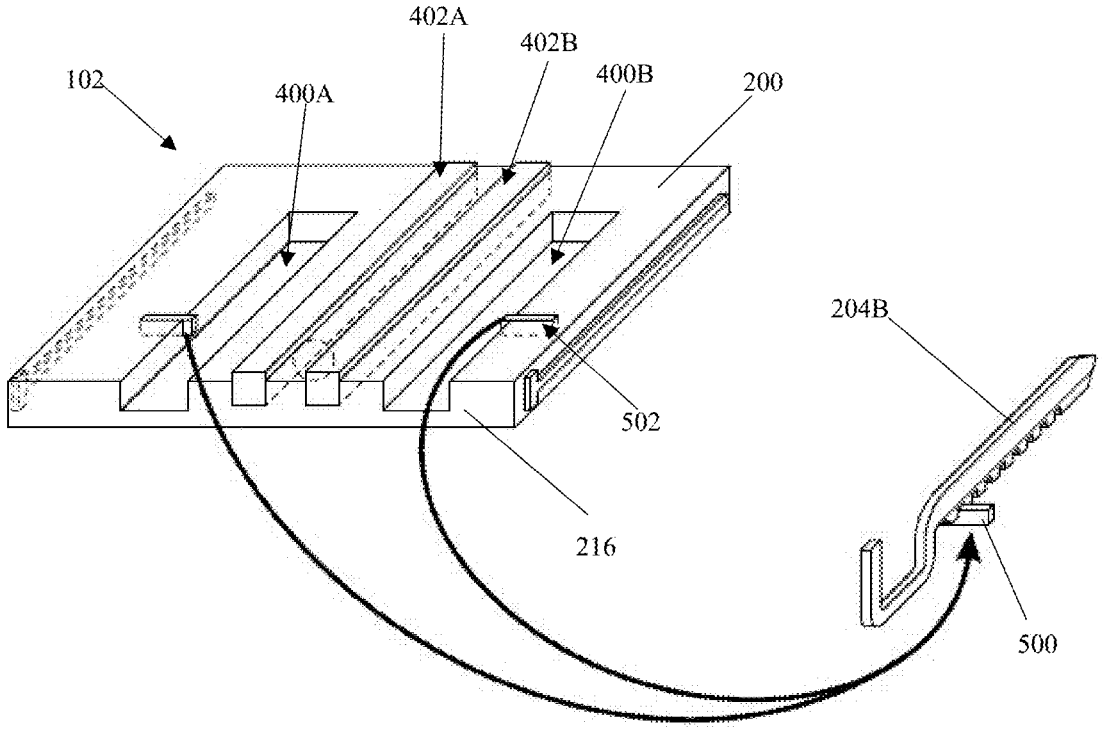
FIG. 5 is a perspective view of an exemplary bottle slider device that can be used with the exemplary breast pump drawer system of FIGS. 4A-B.

Referring to FIG. 5, the breast pump drawer system 102 is illustrated with an exemplary bottle slider device 204B extracted from the slider cavity 400B. In this example, the bottle slider device 204B includes a locking mechanism 500 that locks the bottle slider device 204B into place within complementary locking feature(s) 502 coupled to the slider cavity 400B. For example, the locking mechanism 500 can be a post configured to extend and retract and, when extended, to engage the locking feature 502, which can be a lock recess or cavity, to thereby establish an extension position of the bottle slider device 204B. Any other type of locking mechanisms and/or features can also be used in other examples and the locking mechanism and/or features can be the same or different for each of the bottle slider devices 204A-B.

Figure 6:
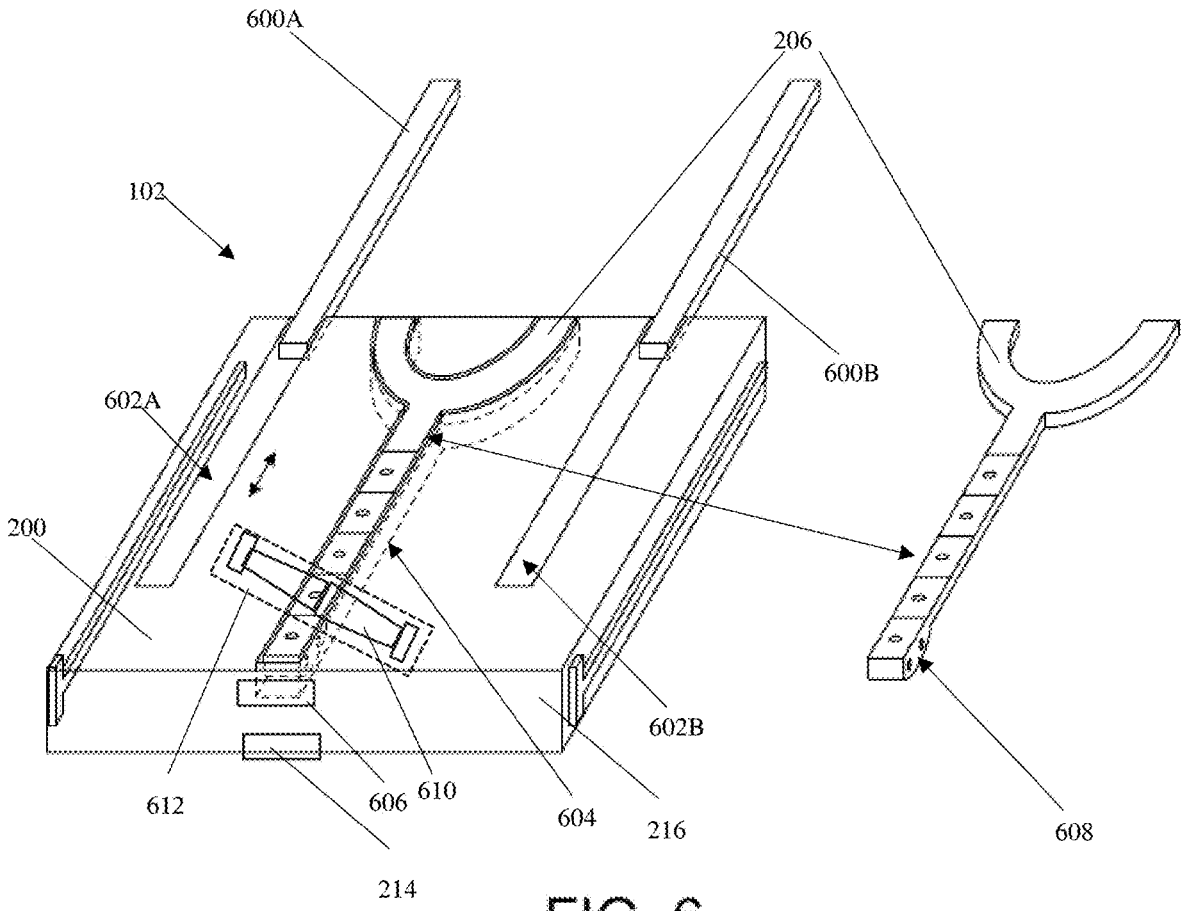
FIG. 6 is a below perspective view of an exemplary breast pump drawer system with integrated drawer supports.

Referring now to FIG. 6, a below perspective view of the exemplary breast pump drawer system 102 with drawer supports 600A-B is illustrated. The breast pump drawer 200 is illustrated with an exemplary drawer supports 600A-B configured to be received by the breast pump drawer 200 via the drawer support cavities 602A-B, respectively. The drawer supports 600A-B can guide the breast pump drawer 200 within the drawer support cavities 602A-B as the breast pump drawer 200 is pushed and pulled, for example, into and out of, respectively, the interior compartment 110 of the containing structure 100.

The bottom of the breast pump drawer 200 in this example further includes a support leg cavity 604, which is configured to receive and retain the base support leg 206 of the breast pump drawer system 102. The base support leg 206 is telescoping to facilitate extension to a particular length, which corresponds to a height of the breast pump drawer 200, the headrest base 210, and/or the headrest cushion 212 in some examples. The desired length of the base support leg 206 can be further dictated by an angle by which the base support leg 206 is placed with respect to a floor and a leg hinge 606 about which the base support leg 206 is configured to rotate, thereby supporting the weight of the breast pump drawer 200.

In this example, the base support leg 206 includes a two-pin locking mechanism 608 by which the base support leg 206 is locked or extended, although other types of locking mechanisms and/or base support legs can also be used in other examples. While one base support leg 206 is disclosed in this example, multiple base support legs can be used in other examples, which can operate in the same or a different manner as the base support leg 206. One or more of the base support legs can have the same or a different shape at a proximal end than the shapes illustrate in FIGS. 2 and 6.

Also illustrated in FIG. 6 is an exemplary bottle attachment device 610, which is coupled to the base support leg 206. In this example, the milk collection system includes the bottle attachment device 610 that is configured to hold bottles for retaining expressed breast milk. For example, the bottles can attach to the bottle attachment device 610 via clips, ball joints, or any other mechanism, and/or slide laterally along the bottle attachment device 610 once attached, to facilitate multiple axis of movement and/or rotation. The breast pump drawer 200 in this example includes an attachment cavity 612 configured to receive and retain the bottle attachment device 610 when the base support leg 206 is rotated about the leg hinge 606 and introduced to the leg cavity 604. The leg cavity 604 and the attachment cavity 612 can be a unitary cavity in some examples. Thus, the bottle attachment device 610 can be used instead of the bottle slider devices 204A-B in this example, and other types of milk collection systems can also be used in other examples.

Having thus described the basic concept of the invention, it will be rather apparent to those skilled in the art that the foregoing detailed disclosure is intended to be presented by way of example only and is not limiting. Various alterations, improvements, and modifications will occur and are intended to those skilled in the art, though not expressly stated herein. These alterations, improvements, and modifications are intended to be suggested hereby, and are within the spirit and scope of the invention.

What is claimed is:

1. A breast pump drawer system, comprising:

a breast pump drawer configured to be slidably received within an interior compartment of a containing structure via one or more guiding components, wherein the breast pump drawer comprises a headrest pin, a headrest cavity, first and second slider cavities, and a support leg cavity;

first and second bottle slider devices configured to be received by at least a portion of the first and second slider cavities, respectively, to thereby be disposed below a top surface of the breast pump drawer, wherein the first and second slider cavities have a first long axis parallel to a second long axis of each of the guiding components and the first and second bottle slider devices are further configured to attach to first and second bottle holders, respectively;

a base support leg configured to be received and retained by at least a portion of the support leg cavity when the breast pump drawer is slidably received by the interior compartment of the containing structure, wherein the support leg cavity is in a bottom of the breast pump drawer and the base support leg is further configured to be positioned between the breast pump drawer and a surface parallel to and below the breast pump drawer to thereby support the breast pump drawer; and a headrest configured to be coupled to the headrest pin and comprising a headrest base configured to be received by at least a portion of the headrest cavity, wherein the headrest is configured to rotate about the headrest pin to a desired angle.

2. The breast pump drawer system of claim 1, wherein each of the first and second bottle slider devices comprises a locking mechanism configured to engage a locking feature disposed proximate a respective one of the first and second slider cavities, to thereby retain the first and second bottle slider devices in an extended position toward a user of the breast pump drawer system, and the first and second bottle holders are for holding bottles configured to receive breast milk expressed by the user.

3. The breast pump drawer system of claim 1, further comprising a chest cushion coupled to headrest base.

4. The breast pump drawer system of claim 1, wherein one or both of the headrest base or the base support leg is telescoping to facilitate and maintain a desired height.

5. The breast pump drawer system of claim 1, wherein the headrest pin is disposed proximate a front surface of the breast pump drawer and the desired angle is relative to the top surface of the breast pump drawer.

6. The breast pump drawer system of claim 1, wherein the headrest base comprises a proximal post and a distal mount and the distal mount is configured to attach to a headrest cushion.

7. The breast pump drawer system of claim 1, further comprising a leg hinge disposed proximate a front surface of the breast pump drawer, wherein the base support leg is configured to rotate about the leg hinge.

8. The breast pump drawer system of claim 1, wherein the containing structure comprises furniture, a changing table, a dresser, a bassinet, or a portable medical treatment cart.

9. A containing structure, comprising:

an interior compartment and one or more guiding components disposed proximate the interior compartment;

a breast pump drawer configured to be slidably received within the interior compartment via the one or more guiding components, wherein the breast pump drawer comprises a headrest cavity, first and second slider cavities, and a support leg cavity;

first and second bottle slider devices configured to be received by at least a portion of the first and second slider cavities, respectively, to thereby be disposed below a top surface of the breast pump drawer, wherein the first and second slider cavities have a first long axis parallel to a second long axis of each of the guiding components;

a base support leg configured to be received and retained by at least a portion of the support leg cavity when the breast pump drawer is slidably received by the interior compartment of the containing structure, wherein the support leg cavity is in a bottom of the breast pump drawer; and a headrest comprising a headrest base configured to be received by at least a portion of the headrest cavity.

10. The containing structure of claim 9, wherein the base support leg is further configured to be positioned between the breast pump drawer and a floor surface to thereby support the breast pump drawer.

11. The containing structure of claim 9, wherein the first and second bottle slider devices are further configured to attach to first and second bottle holders, respectively, for holding bottles configured to receive expressed breast milk.

12. The containing structure of claim 9, wherein the breast pump drawer further comprises a headrest pin, a proximal post of the headrest base is further configured to be coupled to the headrest pin, the headrest is configured to rotate about the headrest pin and lock at a desired angle, and the headrest is height-adjustable via connectivity between the proximal post and a distal mount of the headrest base.

13. The containing structure of claim 12, wherein the headrest pin is disposed proximate a front surface of the breast pump drawer and the desired angle is relative to the top surface of the breast pump drawer.

14. The containing structure of claim 9, wherein each of the first and second bottle slider devices comprises a locking mechanism configured to engage a locking feature disposed proximate a respective one of the first and second slider cavities, to thereby retain the first and second bottle slider devices in an extended position toward a user of the containing structure.

15. The containing structure of claim 9, further comprising a chest cushion coupled to headrest base.

16. The containing structure of claim 9, wherein one or both of the headrest base or the base support leg is telescoping to facilitate and maintain a desired height.

17. The containing structure of claim 9, wherein the, the headrest base comprises a proximal post and a distal mount and the distal mount is configured to attach to a headrest cushion.

18. The containing structure of claim 9, further comprising a leg hinge disposed proximate a front surface of the breast pump drawer, wherein the base support leg is configured to rotate about the leg hinge.

19. The containing structure of claim 9, comprising furniture, a changing table, a dresser, a bassinet, or a portable medical treatment cart.

20. A breast pump drawer system, comprising:

a breast pump drawer configured to be slidably received within an interior compartment of a containing structure via one or more guiding components, wherein the breast pump drawer comprises a headrest cavity, first and second slider cavities, and a support leg cavity;

first and second bottle slider devices configured to be received by at least a portion of the first and second slider cavities, respectively, to thereby be disposed below a top surface of the breast pump drawer, wherein the first and second slider cavities have a first long axis parallel to a second long axis of each of the guiding components and the first and second bottle slider devices are further configured to attach to first and second bottle holders, respectively;

a base support leg configured to be received and retained by at least a portion of the support leg cavity when the breast pump drawer is slidably received by the interior compartment of the containing structure, wherein the support leg cavity is in a bottom of the breast pump drawer and the base support leg is further configured to be positioned between the breast pump drawer and a floor surface to thereby support the breast pump drawer; and a headrest comprising a headrest base configured to be received by at least a portion of the headrest cavity, wherein the headrest is configured to rotate and maintain to a desired angle.

* * * * *